US007551136B1

(12) United States Patent
Kalian et al.

(10) Patent No.: US 7,551,136 B1
(45) Date of Patent: Jun. 23, 2009

(54) MULTI-BEAM PHASED ARRAY ANTENNA FOR LIMITED SCAN APPLICATIONS

(75) Inventors: David Kalian, Redondo Beach, CA (US); Thomas F. Klein, III, Redondo Beach, CA (US); Paul J. Tatomir, Fallbrook, CA (US); Alfred E. Lee, Torrance, CA (US)

(73) Assignee: The Boeing Company, Chiacgo, IL (US)

( * ) Notice: Subject to any disclaimer, the term of this patent is extended or adjusted under 35 U.S.C. 154(b) by 0 days.

(21) Appl. No.: 11/491,685

(22) Filed: Jul. 24, 2006

(51) Int. Cl.
*H01Q 3/00* (2006.01)

(52) U.S. Cl. ..... 342/368

(58) Field of Classification Search ..... 342/368; 343/778

See application file for complete search history.

(56) References Cited

U.S. PATENT DOCUMENTS

| | | | | | |
|---|---|---|---|---|---|
| 5,084,708 | A | | 1/1992 | Champeau et al. | |
| 5,099,254 | A | | 3/1992 | Tsukii et al. | |
| 5,128,689 | A | * | 7/1992 | Wong et al. | 343/853 |
| 5,276,455 | A | * | 1/1994 | Fitzsimmons et al. | 343/777 |
| 5,278,574 | A | * | 1/1994 | Zimmerman et al. | 343/778 |
| 5,305,001 | A | * | 4/1994 | Wong et al. | 343/786 |
| 5,309,409 | A | | 5/1994 | Jones | |
| 5,414,433 | A | | 5/1995 | Chang | |
| 5,459,474 | A | | 10/1995 | Mattioli et al. | |
| 5,488,380 | A | * | 1/1996 | Harvey et al. | 342/368 |
| 5,541,607 | A | | 7/1996 | Reinhardt | |
| 5,565,878 | A | * | 10/1996 | Lagerlof | 343/778 |
| 5,663,683 | A | * | 9/1997 | McCandless | 330/286 |
| 5,907,304 | A | * | 5/1999 | Wilson et al. | 343/700 MS |
| 6,184,827 | B1 | | 2/2001 | Dendy et al. | |
| 6,184,832 | B1 | * | 2/2001 | Geyh et al. | 343/700 MS |
| 6,469,671 | B1 | * | 10/2002 | Pluymers et al. | 343/702 |
| 6,784,837 | B2 | | 8/2004 | Revankar et al. | |
| 6,882,311 | B2 | | 4/2005 | Walker et al. | |

(Continued)

FOREIGN PATENT DOCUMENTS

| | | |
|---|---|---|
| EP | 0 407 243 | 1/1991 |

(Continued)

OTHER PUBLICATIONS

U.S. Appl. No. 11/263,145, Kalian et al.

(Continued)

*Primary Examiner*—Thomas H Tarcza
*Assistant Examiner*—Nga X Nguyen
(74) *Attorney, Agent, or Firm*—Haynes and Boone, LLP

(57) ABSTRACT

Systems and methods are disclosed herein to provide improved phased array antenna system. For example, in accordance with an embodiment of the present invention, a phased array antenna system includes a plurality of horn/filter assemblies. A plurality of modules are adapted to provide RF signals to the horn/filter assemblies. Each of the horn/filter assemblies is mounted on a top surface of a corresponding one of the modules. A thermal system is adapted to cool the modules. The modules are mounted on a first surface of the thermal system. A plurality of distribution boards associated with the modules are mounted on a second surface of the thermal system. A plurality of interconnects associated with the modules are adapted to connect the modules with the distribution boards through the thermal system.

24 Claims, 5 Drawing Sheets

U.S. PATENT DOCUMENTS

| | | | | |
|---|---|---|---|---|
| 6,946,992 | B2 | 9/2005 | McCleary et al. | |
| 6,972,716 | B2 * | 12/2005 | Davis et al. | 342/368 |
| 2002/0018023 | A1 * | 2/2002 | Durham et al. | 343/781 P |
| 2003/0022395 | A1 | 1/2003 | Olds | |
| 2003/0206132 | A1 | 11/2003 | Phelan | |
| 2003/0206134 | A1 | 11/2003 | Lier et al. | |
| 2005/0052333 | A1 * | 3/2005 | Rao et al. | 340/840 |
| 2005/0093744 | A1 | 5/2005 | Davis et al. | |
| 2005/0168301 | A1 * | 8/2005 | Carson | 333/117 |
| 2005/0219137 | A1 * | 10/2005 | Heisen et al. | 343/776 |

FOREIGN PATENT DOCUMENTS

| | | |
|---|---|---|
| JP | 2005038933 | 10/2005 |
| WO | WO 03/063299 | 7/2003 |

OTHER PUBLICATIONS

U.S. Appl. No. 12/042,574, Kalian et al.

Notification Of Transmittal of the International Search Report and the Written Opinion of the International Searching Authority mailed Jan. 23, 2007 for International Patent Application No. PCT/US2006/028940 (3 pages).

International Search Report mailed Jan. 23, 2007 for International Patent Application No. PCT/US2006/028940 (6 pages).

Written Opinion of the International Searching Authority mailed Jan. 23, 2007 for International Patent Application No. PCT/US2006/028940 (10 pages).

International Search Report mailed Nov. 1, 2006 for International Patent Application No. PCT/US2006/028940 (8 pages).

* cited by examiner

MULTI-BEAM PHASED ARRAY ANTENNA FOR LIMITED SCAN APPLICATIONS

TECHNICAL FIELD

The present invention relates generally to antenna-based communication systems and, more particularly, to phased array antenna systems.

BACKGROUND

Modern communication systems frequently have capacity and connectivity needs which can be met or enhanced by multi-beam phased array antenna systems. In this regard, phased array antenna systems offer various advantages including agile beams with short beam switching times to minimize communication outages. Such systems also offer beam shaping features to optimize coverage over particular service regions while also minimizing emissions elsewhere.

Existing phased array antenna systems generally include a multitude of individual parts and subassemblies which must work together as an integrated whole. The complexity of such systems can often render them prohibitively expensive. For example, phased array antenna systems typically require lengthy multi-stage implementation and testing schedules. However, after individual components have been assembled and integrated into the system, access to such components may be severely limited or impossible without extensive disassembly of the system and removal of additional components.

In particular, access to RF module electronics of phased array antenna systems can be especially burdensome after assembly of the system. Such modules may contain sensitive monolithic microwave integrated circuit (MMIC) devices which, when faulty, can require servicing of the modules. Typically, in conventional configurations, one or more distribution boards of the system must be removed in order to access a faulty module. However, the removal of additional components, especially electronic components, increases the risk of further damage to the system during servicing.

Moreover, after a module has been serviced, previously removed components must be retested and reinstalled to ensure proper operation of the system. Costs associated with these efforts can limit the ability to provide phased array antenna systems at reasonable cost. As a result, the deployment of phased array antenna systems can be limited to very high end commercial or government-funded systems. Moreover, the large numbers of dedicated individual parts and subassemblies of existing systems can lead to excessive part counts with considerable mass associated therewith.

Accordingly, there is a need for an improved phased array antenna system structure that permits servicing of various components without requiring extensive removal of large numbers of other previously-assembled components, thereby saving time and costs associated with removal, testing, and reassembly. In addition, there is a need for an improved structure that provides reduced part counts, reduced mass, and components suitable for multi-purpose use in comparison to existing designs identified above. There is also a need for an improved method of servicing phased array antenna systems utilizing the improved structure.

SUMMARY

In accordance with one embodiment of the present invention, a phased array antenna system includes a plurality of horn/filter assemblies; a plurality of modules adapted to provide RF signals to the horn/filter assemblies, wherein each of the horn/filter assemblies is mounted on a top surface of a corresponding one of the modules; a thermal system adapted to cool the modules, wherein the modules are mounted on a first surface of the thermal system; a plurality of distribution boards associated with the modules and mounted on a second surface of the thermal system; and a plurality of interconnects associated with the modules and adapted to connect the modules with the distribution boards through the thermal system.

In accordance with another embodiment of the present invention, a method of servicing a phased array antenna system includes providing a horn/filter assembly attached to a module adapted to provide RF signals to the horn/filter assembly; accessing the module, wherein the module is mounted on a first surface of a thermal system and interconnected with a distribution board mounted on a second surface of the thermal system; and servicing the module without requiring removal of the distribution board and without disassembly of the thermal system.

In accordance with another embodiment of the present invention, a satellite system includes a satellite; and a phased array antenna system comprising: a plurality of horn/filter assemblies, a plurality of modules adapted to provide RF signals to the horn/filter assemblies, wherein each of the horn/filter assemblies is mounted on a top surface of a corresponding one of the modules, a thermal system adapted to cool the modules, wherein the modules are mounted on a first surface of the thermal system, a plurality of distribution boards associated with the modules and mounted on a second surface of the thermal system, and a plurality of interconnects associated with the modules and adapted to connect the modules with the distribution boards through the thermal system.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
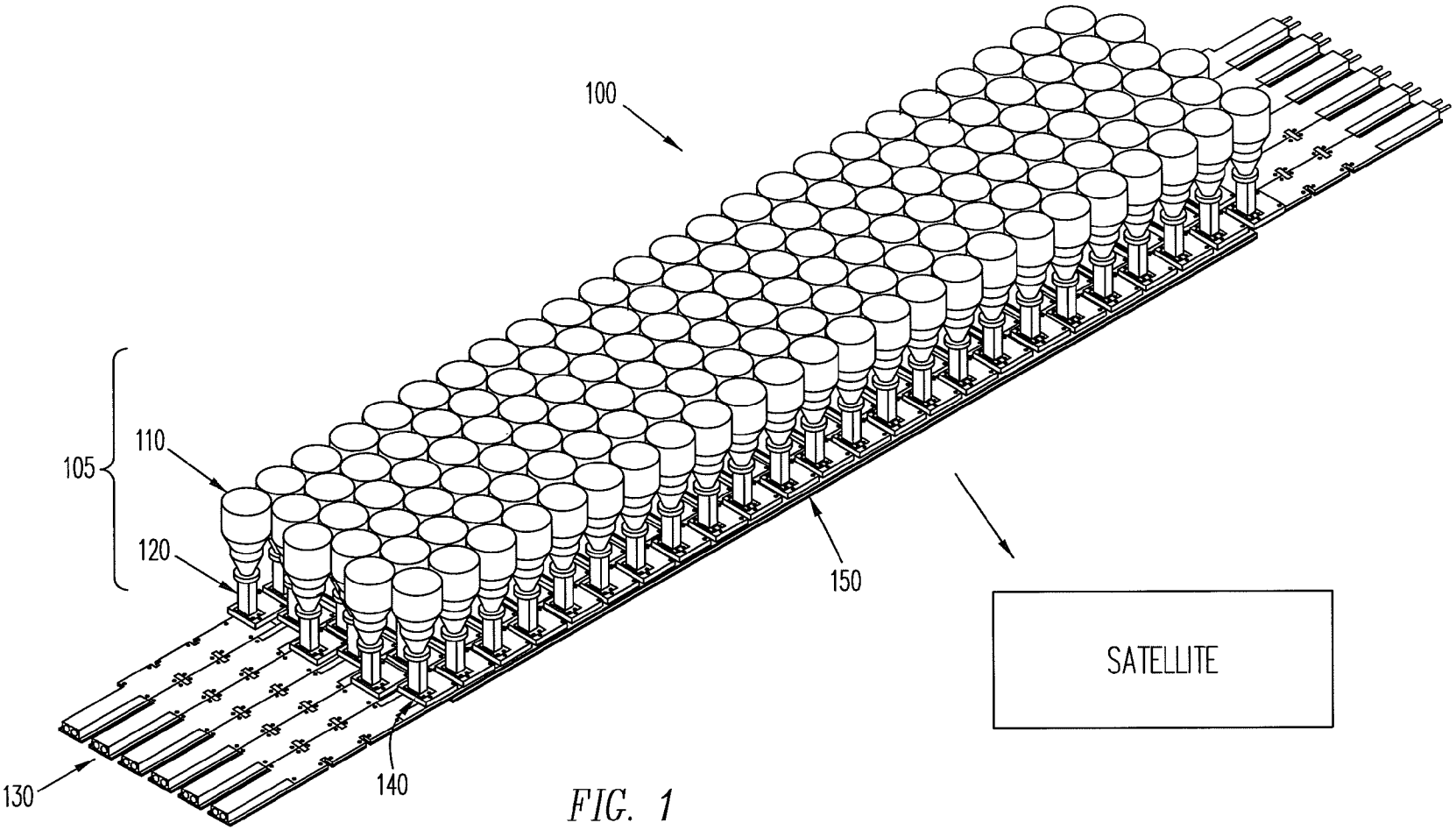
FIG. 1 illustrates a perspective view of a phased array antenna system in accordance with an embodiment of the present invention.

FIG. 1 illustrates a perspective view of a phased array antenna system 100 in accordance with an embodiment of the present invention. In various embodiments, phased array antenna system 100 may be utilized for limited scan communications in the Ku frequency band. For example, in one embodiment, phased array antenna system 100 may be deployed on a satellite. As further described herein, phased array antenna system 100 can be conveniently serviced following removal of a limited number of components, thereby reducing time and costs associated with testing and reassembly.

As illustrated, phased array antenna system 100 includes a plurality of horn/filter assemblies 105 which include a plurality of feed horns 110 engaged with a plurality of filters 120. Horn/filter assemblies 105 may be arranged in various patterns and used to transmit and/or receive RF communications to and from phased array antenna system 100. For example, in the embodiment illustrated in FIG. 1, horn/filter assemblies 105 are arranged in a triangular pattern. However, other arrangements may also be used, such as square, sparse, or random lattice patterns as such terminology will be understood by those skilled in the art. In various embodiments, horn/filter assemblies 105 may be machined or formed from metal or plastic, or may be alternatively implemented using printed circuit boards or active component boards having associated radiating elements as such components are understood by those skilled in the art.

Phased array antenna system 100 also includes a plurality of modules 140 to provide phase shifting and/or time delay and attenuation and amplification for RF signals transmitted or received through associated horn/filter assemblies 105. As further described herein, modules 140 are interfaced with a plurality of distribution boards 150 which may distribute signals to modules 140. Distribution boards 150 may be implemented as single-layer or multi-layer boards. For example, in one embodiment, distribution boards 150 may be implemented with a multi-layer (i.e., one or more) RF distribution layer and a separate multi-layer (i.e., one or more) DC/signal controls layer as understood by those skilled in the art. The RF and DC controls layers may be interlaced with each other (e.g., to facilitate connections between the layers), bonded together, mechanically attached (e.g., screwed together), or otherwise joined, as also understood by those skilled in the art.

As illustrated, individual horn/filter assemblies 105 may be mounted directly on associated modules 140. For example, each of filters may be mechanically engaged with an associated module 140. In one embodiment, such engagement can be implemented by an interlock mechanization of the two parts, thus allowing access to each module 140 after removal of its associated horn/filter assembly 105.

In one embodiment, individual horn/filter assemblies 105 may screw on to modules 140. It will be appreciated that horn/filter assemblies 105 may alternatively be engaged with modules 140 using snap-in (i.e., blind mate) fittings as will be understood by those skilled in the art. In one embodiment, feed horns 110 may be implemented with a substantially circular cross-section (for example, having a substantially cylindrical external shape) to facilitate rotation of individual feed horns 110 without requiring excessive gaps between feed horns 110.

However, it will be appreciated that feed horns 110 may alternatively be implemented using other shapes. For example, in one embodiment, each of feed horns 110 may exhibit a substantially square cross-section. In such an embodiment, gaps may be provided between such feed horns 110 in order to facilitate access for removal of mounting screws of such feed horns 110. In addition, such gaps can facilitate access to mounting screws of modules 140.

As will be appreciated by those skilled in the art, horn/filter assemblies 105 may optionally include appropriate transition hardware (not shown) onto which horn 110 or filter 120 may be screwed on, snapped on, or otherwise connected to facilitate the attachment of various-sized horns 110, filters 120, and modules 140. In another embodiment, each of horn/filter assemblies 105 may be implemented as a single piece attached to modules 140 (for example, attached by screws) and may be removed together with modules 140 for servicing.

As illustrated, modules 140 and distribution boards 150 are mounted on complementary external surfaces of a thermal system 130. Thermal system 130 can be implemented to provide cooling for modules 140 and distribution boards 150, as well as to provide structural support for phased array antenna system 100. In this regard, modules 140 and distribution boards 150 may be mounted on thermal system 130 in an appropriate manner to support heat conductivity between such components and thermal system 130. For example, in one embodiment, surfaces of modules 140 may be mounted directly on a top surface of thermal system 130. Distribution boards 150 may be mounted directly on a bottom surface of thermal system 130, and may be mounted flat on thermal system 130 (as will be further shown in the embodiment of FIG. 3 discussed herein). Advantageously, the mounting of distribution boards 150 on the bottom surface of thermal system 130 can facilitate the addition of further components and/or daughter boards (not shown) to distribution boards 150 in order to provide DC power and controls functionality as may be desired in particular applications. Modules 140 and distribution boards 150 may be held in place by appropriate screws or other engagement members.

Figure 2:
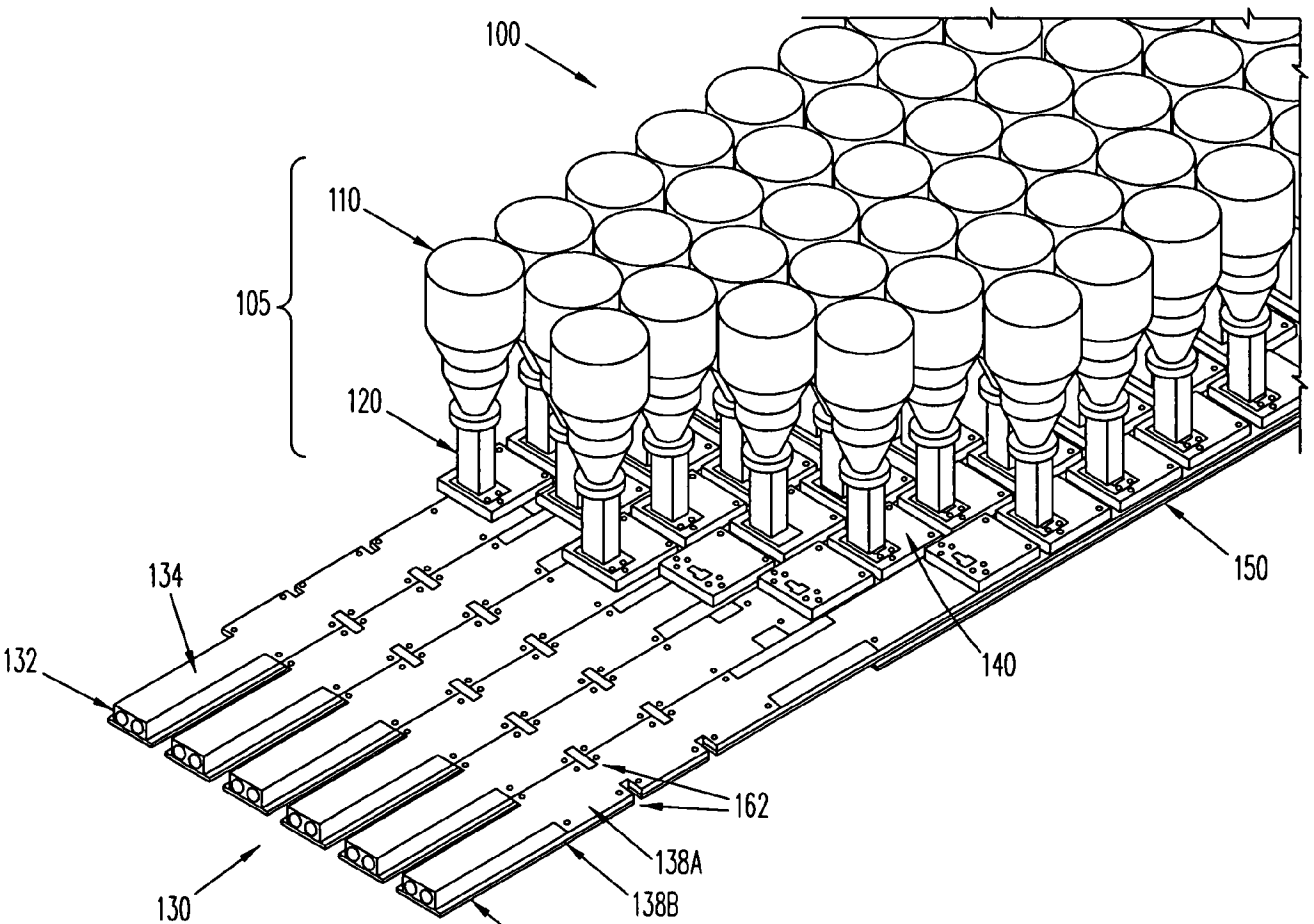
FIG. 2 illustrates an enlarged view of the phased array antenna system of FIG. 1 in accordance with an embodiment of the present invention.

FIG. 2 illustrates an enlarged view of phased array antenna system 100 in accordance with an embodiment of the present invention. In particular, FIG. 2 illustrates further detail of thermal system 130. As illustrated, thermal system 130 may include a plurality of heat pipes 132 embedded between top and bottom heat spreader plates 134 and 136, respectively. In one embodiment, heat pipes 132, top heat spreader plate 134, and bottom heat spreader plate 136 may be mechanically joined to form thermal system 130. In another embodiment, thermal system 130 may be implemented by a thermal plate supporting pumped fluid as will be understood by those skilled in the art.

In the embodiment of FIG. 2, modules 140 may be affixed to top heat spreader plate 134 and distribution boards 150 may be affixed to bottom heat spreader plate 136. For example, top heat spreader plate 134 and bottom heat spreader plate 136 may include a plurality of flanges 138A and 138B, respectively, to facilitate the mounting of modules 140 and distribution boards 150 onto thermal system 130. As shown in FIG. 2, top heat spreader plate 136 includes flanges 138A onto which modules 140 may be mounted. Similarly, bottom heat spreader plate 136 includes flanges 138B onto which distribution boards 150 may be mounted. A plurality of cutouts 162 may be provided in top and bottom heat spreader plates 134 and 136, respectively, and between heat pipes 132 in order to facilitate the passage of interconnects therethrough for connecting modules 140 and distribution boards 150, as further described herein.

In another embodiment, heat pipes 132, top heat spreader plate 134, and bottom heat spreader plate 136 may be bonded together and installed within a honeycomb enclosure (not shown) as will be understood by those skilled in the art, with modules 140 affixed to a first side of the enclosure, and distribution boards 150 affixed to a second side of the enclosure.

Figure 3:
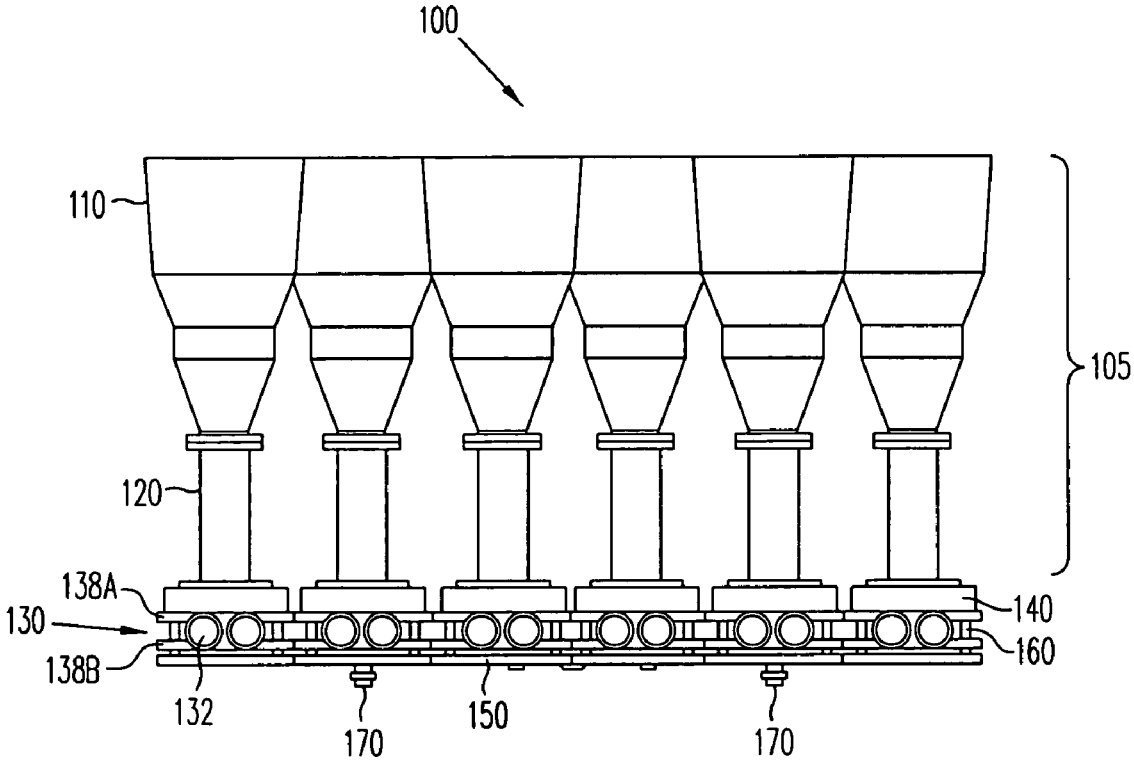
FIG. 3 illustrates a cross-sectional side view of the phased array antenna system of FIG. 1 in accordance with an embodiment of the present invention.

FIG. 3 illustrates a cross-sectional side view of phased array antenna system 100 in accordance with an embodiment of the present invention. As previously described in relation to FIG. 2, modules 140 may be mounted on flanges 138A and distribution boards 150 may be mounted on flanges 138B.

Input/output ports 170 are provided on one or more of distribution boards 150 to receive signals for transmission from phased array antenna system 100 and/or to provide signals received by phased array antenna system 100. Input/output ports 170 may be provided on a bottom surface of distribution boards 150 (as illustrated in FIG. 3) or, alternatively, may be implemented as edge-mount connectors provided on sides of distribution boards 150.

As also shown in FIG. 3, modules 140 are connected with distribution boards 150 through a plurality of interconnects 160 that extend through thermal system 130. As previously described cutouts 162 (see FIG. 2) may be provided in top heat spreader plate 134, in bottom heat spreader plate 136, and between heat pipes 132 to allow passage of interconnects 160 through thermal system 130. Interconnects 160 may be implemented using any appropriate connection apparatus such as, for example, blind mate interconnects (e.g., GPO interconnects), fuzz button interconnects, probe-type interconnects, jumpers, or others.

Figure 4A:
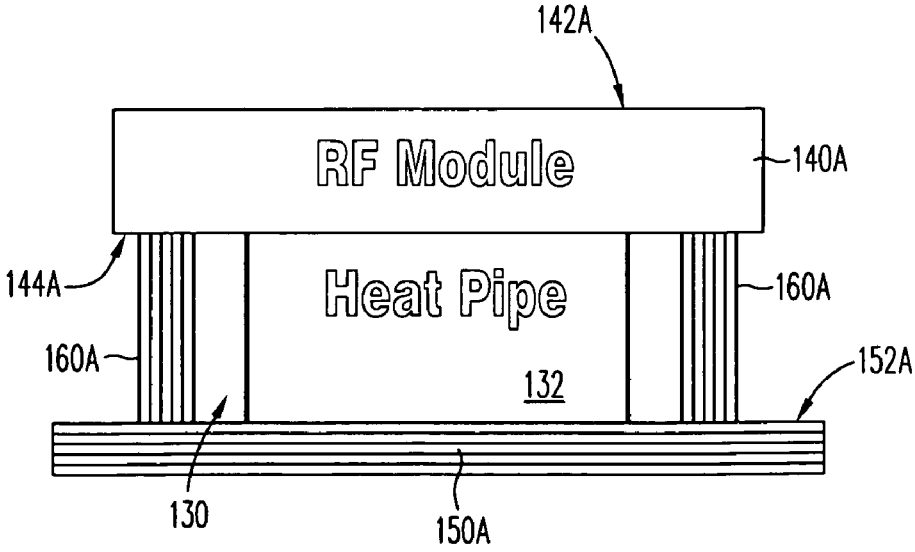
FIGS. 4A-E illustrate stack-up configurations of individual modules and distribution boards of the phased array antenna system of FIG. 1 in accordance with various embodiments of the present invention.

FIGS. 4A-E illustrate a variety of stack-up configurations of individual modules 140 and distribution boards 150 of phased array antenna system 100 in accordance with various embodiments of the present invention. For example, FIG. 4A illustrates an embodiment 140A of one of modules 140 connected with an embodiment 150A of one of distribution boards 150 through embodiments 160A of interconnects 160. Module 140A includes top and bottom surfaces 142A and 144A, respectively. In this regard, top surface 142A may receive one of filters 120 (not shown in FIG. 4A) which may be affixed to top surface 142A in accordance with various techniques described herein. Bottom surface 144A of module 140A may be engaged with thermal system 130 such as a top surface of one of heat pipes 132 (as illustrated) or top heat spreader plate 134 (not shown in FIG. 4A). Distribution board 150A may be engaged with thermal system 130 such as a bottom surface of one of heat pipes 132 (as illustrated) or bottom heat spreader plate 136 (not shown in FIG. 4A).

Interconnects 160A facilitate communication between module 140A and distribution board 150A. In the embodiment of FIG. 4A, interconnects 160A may be implemented to connect bottom surface 144A of module 140A to a top surface 152A of distribution board 150A through thermal system 130. As illustrated, interconnects 160A may substantially span the depth of thermal system 130.

Figure 4B:
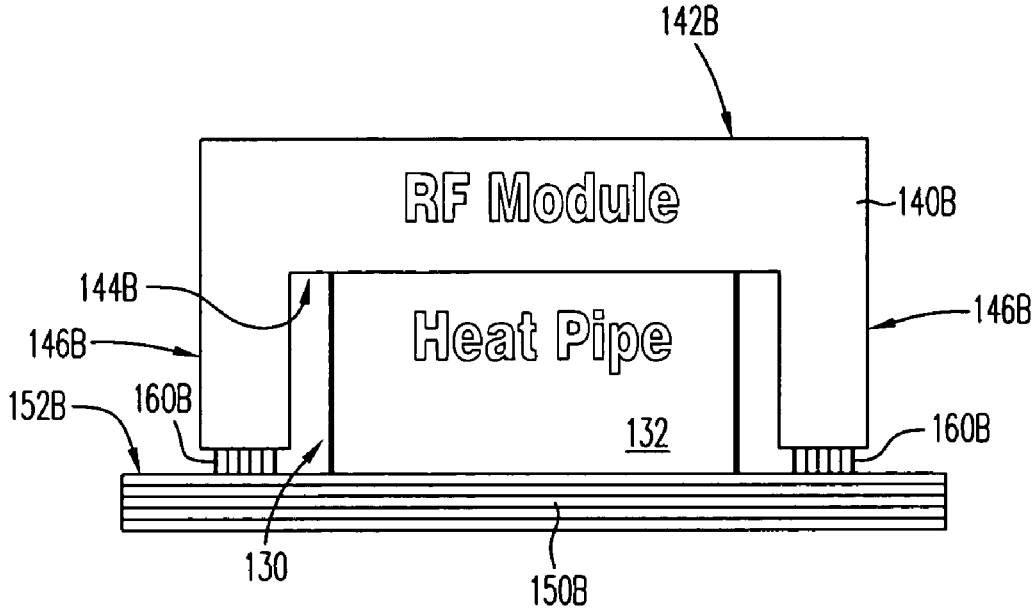

FIG. 4B illustrates an embodiment 140B of one of modules 140 connected with an embodiment 150B of one of distribution boards 150 through embodiments 160B of interconnects 160. Module 140A includes top and bottom surfaces 142B and 144B, respectively. As similarly described in relation to the embodiment of FIG. 4A, one of filters 120 (not shown in FIG. 4B) may be affixed to module 140B, module 140B may be engaged with thermal system 130, and distribution board 150B may be engaged with thermal system 130. As illustrated in FIG. 4B, module 140B further includes leg members 146B which may extend toward distribution board 150B through thermal system 130.

Interconnects 160B facilitate communication between module 140B and distribution board 150B. In the embodiment of FIG. 4B, interconnects 160A may be implemented to connect leg members 146B of module 140B to a top surface 152B of distribution board 150B through thermal system 130. It will be appreciated that the use of leg members 146B can permit the use of shorter interconnects 160B in comparison with interconnects 160A of FIG. 4A.

Figure 4C:
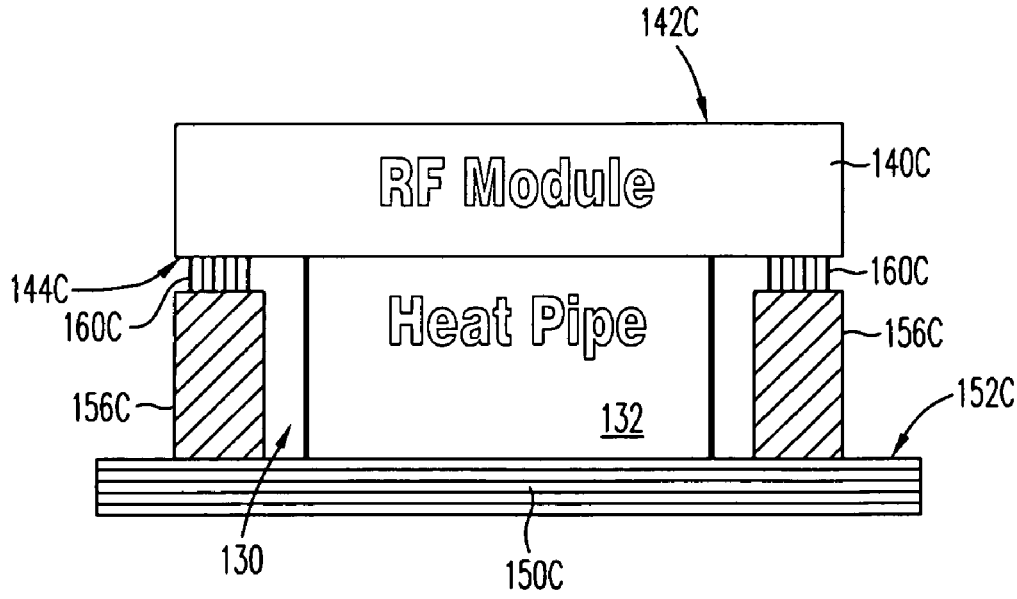

FIG. 4C illustrates an embodiment 140C of one of modules 140 connected with an embodiment 150C of one of distribution boards 150 through embodiments 160C of interconnects 160. Module 140C includes top and bottom surfaces 142C and 144C, respectively. As similarly described in relation to the embodiments of FIGS. 4A-B, one of filters 120 (not shown in FIG. 4C) may be affixed to module 140C, module 140C may be engaged with thermal system 130, and distribution board 150C may be engaged with thermal system 130. As illustrated in FIG. 4C, distribution board 150C may include a plurality of base members 156C on a top surface 152C, wherein the base members 156C may extend toward module 140C through thermal system 130.

Interconnects 160C facilitate communication between module 140C and distribution board 150C. In the embodiment of FIG. 4C, interconnects 160C may be implemented to connect bottom surface 144C of module 140C to base members 152C through thermal system 130. It will be appreciated that the use of base members 156C can permit the use of shorter interconnects 160C in comparison with interconnects 160A of FIG. 4A.

Figure 4D:
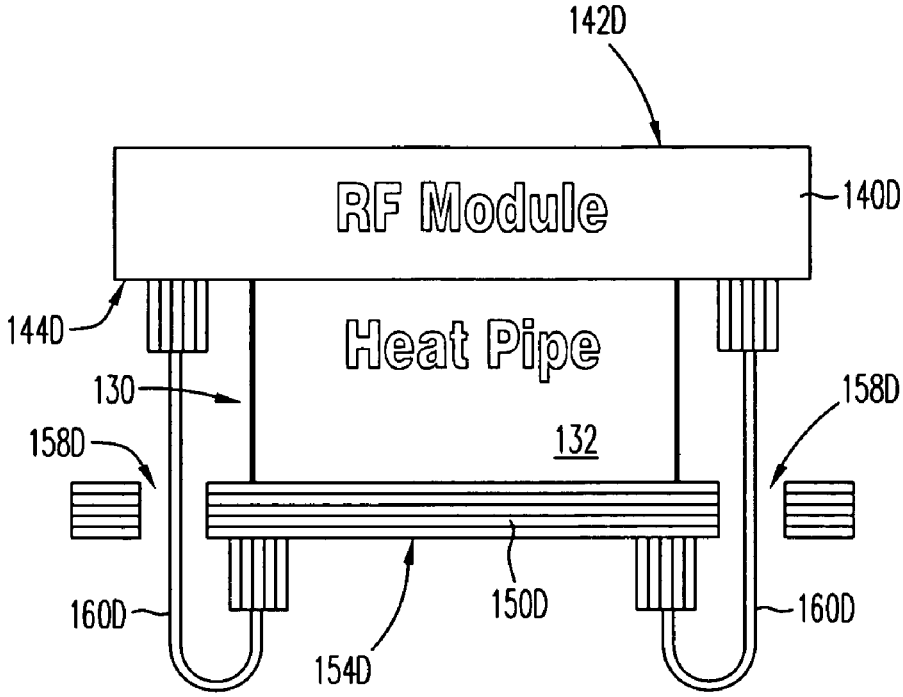

FIG. 4D illustrates an embodiment 140D of one of modules 140 connected with an embodiment 150D of one of distribution boards 150 through flexible jumpers 160D. Flexible jumpers 160D may be shielded and connected and/or soldered to module 140D and distribution board 150D. Module 140D includes top and bottom surfaces 142D and 144D, respectively. As similarly described in relation to the embodiments of FIGS. 4A-C, one of filters 120 (not shown in FIG. 4D) may be affixed to module 140D, module 140D may be engaged with thermal system 130, and distribution board 150D may be engaged with thermal system 130.

Flexible jumpers 160D may be used to facilitate communication between module 140D and distribution board 150D. Specifically, flexible jumpers 160D may be implemented to connect bottom surface 144D of module 140D to a bottom surface 154D of distribution board 150D through thermal system 130. In this regard, distribution board 150D may further include a plurality of apertures 158D to permit passage of flexible jumpers 160D through to bottom surface 154D. It will be appreciated that, in contrast to interconnects 160A-C previously described in relation to FIGS. 4A-C, flexible jumpers 160D may be implemented to bend, thereby permitting bottom surface 144D of module 140D to be connected with bottom surface 154D of distribution board 150D.

Figure 4E:
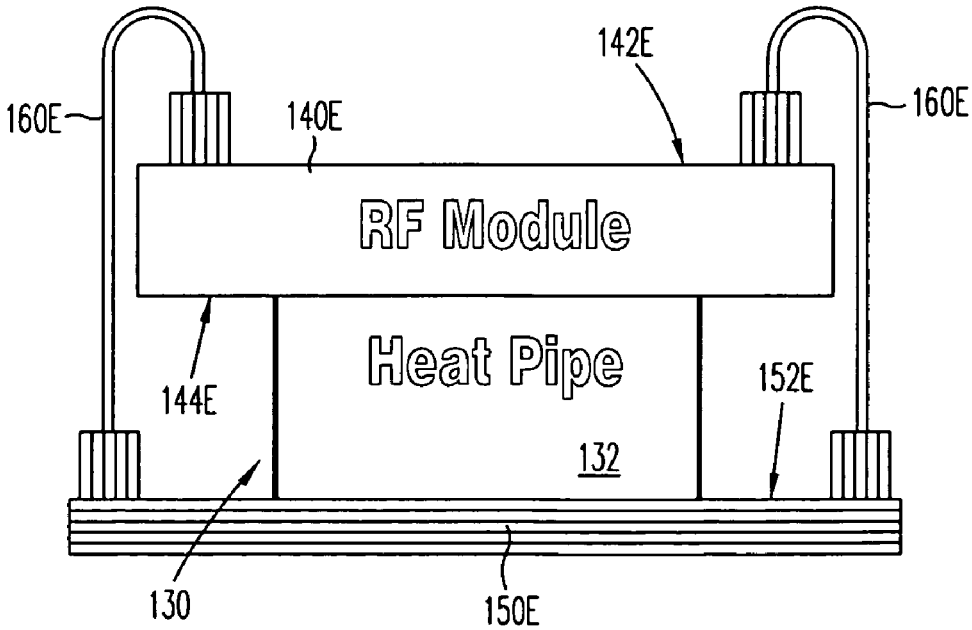

FIG. 4E illustrates an embodiment 140E of one of modules 140 connected with an embodiment 150E of one of distribution boards 150 through flexible jumpers 160E which may be implemented similar to flexible jumpers 160D previously described in relation to FIG. 4D. Module 140E includes top and bottom surfaces 142E and 144E, respectively. As similarly described in relation to the embodiments of FIGS. 4A-D, one of filters 120 (not shown in FIG. 4E) may be affixed to module 140E, module 140E may be engaged with thermal system 130, and distribution board 150E may be engaged with thermal system 130.

As similarly described in relation to FIG. 4D, flexible jumpers 160E may be used to facilitate communication between module 140E and distribution board 150E. Specifically, flexible jumpers 160E may be implemented to connect top surface 142E of module 140E to a top surface 152E of distribution board 150E through thermal system 130. As also similarly described in relation to FIG. 4D, flexible jumpers 160E may be implemented to bend, thereby permitting top surface 142E of module 140E to be connected with top surface 152E of distribution board 150E.

In view of the present disclosure, it will be appreciated that an improved phased array antenna system 100 as set forth herein can facilitate convenient servicing of modules 140 without extensive disassembly of thermal system 130 or distribution boards 150. For example, individual horn/filter assemblies 105 associated with particular modules 140 may be removed (e.g., unscrewed or otherwise disengaged from modules 150) to permit servicing of modules 140 which may include in-system servicing and/or removal of modules 140. Because such an arrangement can reduce the number of components which must be disassembled, reassembled, and tested during repairs, significant time and cost savings can be realized. In addition, the risk of potential damage to otherwise operational components of phased array antenna system 100 or related systems (e.g., a satellite) may be reduced. Advantageously, the structure of phased array antenna system 100 also permits modules 140 and distribution boards 150 to be mounted directly to thermal system 130 which facilitates cooling of such components and provides structural support.

In addition, phased array antenna system 100 can also exhibit reduced part counts providing mass reductions in excess of 50% in comparison with conventional designs. As a result, in embodiments where phased array antenna system 100 may be deployed on a satellite, additional payload may be accommodated.

Embodiments described above illustrate but do not limit the invention. It should also be understood that numerous modifications and variations are possible in accordance with the principles of the present invention. Accordingly, the scope of the invention is defined only by the claims.

We claim:

1. A phased array antenna system comprising:

a plurality of horn/filter assemblies;

a plurality of modules adapted to adjust RF signals provided to the horn/filter assemblies, wherein each of the horn/filter assemblies is mounted on a top surface of a corresponding one of the modules, wherein the modules are adapted to be serviced upon removal of the modules and the horn/filter assemblies from the phased array antenna system;

a thermal system adapted to cool the modules, wherein the thermal system comprises a plurality of heat pipes and first and second heat spreader plates, wherein the heat pipes are embedded between the heat spreader plates, wherein the modules are mounted on the first heat spreader plate, wherein the first heat spreader plate corresponds to a first external surface of the thermal system;

a plurality of distribution boards associated with the modules and mounted on the second heat spreader plate of the thermal system, wherein the second heat spreader plate corresponds to a second external surface of the thermal system, wherein the second external surface is complementary to the first surface; and a plurality of interconnects associated with the modules and adapted to connect the modules with the distribution boards through the thermal system.

2. The phased array antenna system of claim 1, wherein the modules are adapted to be serviced without removal of the distribution boards and without disassembly of the thermal system.

3. The phased array antenna system of claim 1, wherein the modules are adapted to be serviced upon removal of the horn/filter assemblies from the modules.

4. The phased array antenna system of claim 1, wherein the distribution boards are implemented as multi-layer boards having one or more layers adapted to provide RF distribution and one or more layers adapted to provide DC/signal control.

5. The phased array antenna system of claim 1, wherein the thermal system includes a plurality of flanges adapted to receive the modules on the first heat spreader plate of the thermal system and further adapted to receive the distribution boards on the second heat spreader plate of the thermal system.

6. The phased array antenna system of claim 1, wherein the horn/filter assemblies are adapted to screw into the top surfaces of the modules.

7. The phased array antenna system of claim 1, wherein the horn/filter assemblies are adapted to snap into the top surfaces of the modules.

8. The phased array antenna system of claim 5, wherein each of the horn/filter assemblies comprises a feed horn connected with a filter, wherein the filter is engaged with the top surface of the corresponding one of the modules.

9. The phased array antenna system of claim 1, wherein the feed horns have a substantially circular cross-section.

10. The phased array antenna system of claim 1, wherein the feed horns have a substantially square cross-section.

11. The phased array antenna system of claim 1, wherein the interconnects are blind mate interconnects.

12. The phased array antenna system of claim 1, wherein the interconnects substantially span a depth of the thermal system.

13. The phased array antenna system of claim 1, wherein the modules include a plurality of leg members that extend at least partially through the thermal system toward the distribution boards, wherein the interconnects connect the leg members to the distribution boards.

14. The phased array antenna system of claim 1, wherein the distribution boards include a plurality of base members that extend at least partially through the thermal system toward the modules, wherein the interconnects connect the base members to the modules.

15. The phased array antenna system of claim 1, wherein the interconnects are implemented as flexible jumpers, wherein the distribution boards comprise a plurality of apertures to permit passage of the flexible jumpers therethrough, wherein the flexible jumpers connect bottom surfaces of the modules with bottom surfaces of the distribution boards.

16. The phased array antenna system of claim 1, wherein the interconnects are implemented as flexible jumpers, wherein the flexible jumpers connect the top surfaces of the modules with top surfaces of the distribution boards.

17. A method of servicing a phased array antenna system, the method comprising:

accessing one of a plurality of modules of the phased array antenna system, wherein the phased array antenna system comprises:

a plurality of horn/filter assemblies;

the modules, wherein the modules are adapted to adjust RF signals provided to the horn/filter assemblies, wherein each of the horn/filter assemblies is mounted on a top surface of a corresponding one of the modules, wherein the modules are adapted to be serviced upon removal of the modules and the horn/filter assemblies from the phased array antenna system;

a thermal system adapted to cool the modules, wherein the thermal system comprises a plurality of heat pipes and first and second heat spreader plates, wherein the heat pipes are embedded between the heat spreader plates, wherein the modules are mounted on the first heat spreader plate, wherein the first heat spreader plate corresponds to a first external surface of the thermal system;

a plurality of distribution boards associated with the modules and mounted on the second heat spreader plate of the thermal system, wherein the second heat spreader plate corresponds to a second external surface of the thermal system, wherein the second external surface is complementary to the first surface; and a plurality of interconnects associated with the modules and adapted to connect the modules with the distribution boards through the thermal system.

18. The method of claim 17, further comprising removing one of the horn/filter assemblies from the one of the modules.

19. The method of claim 17, further comprising removing the one of the modules from the thermal system with one of the horn/filter assemblies.

20. The method of claim 17, further comprising unscrewing one of the horn/filter assemblies from the one of the modules.

21. The method of claim 17, further comprising unsnapping one of the horn/filter assemblies assembly from the one of the modules.

22. A satellite system comprising:

a satellite; and a phased array antenna system adapted to be deployed on the satellite, the phased array antenna system comprising:

a plurality of horn/filter assemblies, a plurality of modules adapted to adjust RF signals provided to the horn/filter assemblies, wherein each of the horn/filter assemblies is mounted on a top surface of a corresponding one of the modules, wherein the modules are adapted to be serviced upon removal of the modules and the horn/filter assemblies from the phased array antenna system, a thermal system adapted to cool the modules, wherein the thermal system comprises a plurality of heat pipes and first and second heat spreader plates, wherein the heat pipes are embedded between the heat spreader plates, wherein the modules are mounted on the first heat spreader plate, wherein the first heat spreader plate corresponds to a first external surface of the thermal system, a plurality of distribution boards associated with the modules and mounted on the second heat spreader plate of the thermal system, wherein the second heat spreader plate corresponds to a second external surface of the thermal system, wherein the second external surface is complementary to the first surface, and a plurality of interconnects associated with the modules and adapted to connect the modules with the distribution boards through the thermal system.

23. The satellite system of claim 22, wherein the modules are adapted to be serviced without removal of the distribution boards and without disassembly of the thermal system.

24. The method of claim 17, further comprising servicing the one of the modules without requiring removal of one of the distribution boards associated with the one of the modules and without disassembly of the thermal system.

* * * * *